US006044912A

United States Patent [19]

Tsuji et al.

[11] Patent Number: 6,044,912

[45] Date of Patent: Apr. 4, 2000

[54] SPRINKLER HEAD

[75] Inventors: Toshihide Tsuji, Sagamihara; Katsuaki Tonomura, Yokohama; Suguru Shimokawa, Hachiouji, all of Japan

[73] Assignee: Hochiki Kabushiki Kaisha, Tokyo, Japan

[21] Appl. No.: 09/260,891

[22] Filed: Mar. 2, 1999

[30] Foreign Application Priority Data

Mar. 13, 1998 [JP] Japan ..... 10-063024

[51] Int. Cl.[7] ..... A62C 37/08; A62C 37/36

[52] U.S. Cl. ..... 169/37; 169/42; 277/910

[58] Field of Search ..... 169/38, 37, 90, 169/42; 285/918; 277/946, 945, 569

[56] References Cited

U.S. PATENT DOCUMENTS

| | | | |
|---|---|---|---|
| 3,584,689 | 6/1971 | Willms | 169/38 |
| 4,025,050 | 5/1977 | Manki et al. | 251/306 |
| 4,830,117 | 5/1989 | Capasso | 169/90 |
| 5,310,846 | 5/1994 | Inomata et al. | 528/24 |

FOREIGN PATENT DOCUMENTS

| | | |
|---|---|---|
| 163552 | of 1989 | Japan . |
| 212382 | of 1992 | Japan . |
| 36677 | of 1995 | Japan . |

*Primary Examiner*—Kevin Weldon
*Assistant Examiner*—Davis Hwu
*Attorney, Agent, or Firm*—Lackenbach Siegel

[57] ABSTRACT

A sprinkler head connected with a fire extinguishing piping maintains a valve body in a closed state so as to contain compressed fire extinguishing water filled in a fire extinguishing piping when there is no fire, but opens and operates the valve body so as to discharge the compressed and supplied fire extinguishing water at the time of a fire. The fire extinguishing water is contained by closing the gap between the valve body and the peripheral part of the valve body by a sealing member mounted in the valve body, prepared by coating a rubber base material with a fluorine contained resin coating material. The rubber base material of the sealing member can have a round, oval, U-shaped, Y-shaped, or X-shaped cross-sectional shape. The rubber base material can be made from a fluorine rubber or a silicon rubber. The present invention is to utilize both advantages of the anti-corrosion property and the weathering resistance of a fluorine resin and the elasticity of a rubber, to obtain the sealing property with respect to the fire extinguishing water with a smaller load, and to prevent the malfunction of the sprinkler head caused by alteration or adhesion.

7 Claims, 4 Drawing Sheets

SPRINKLER HEAD

BACKGROUND OF THE INVENTION

1. Field of the Invention

The present invention relates to a closed type sprinkler head, connected with a fire extinguishing piping, for containing compressed fire extinguishing water filled in the fire extinguishing piping in the ordinary time, and discharging the compressed and supplied fire extinguishing water at the time of a fire.

2. Description of the Related Art

In the conventional sprinkler fire extinguishing equipment, a stemmed piping stemmed from a water supply piping for supplying fire extinguishing water is provided in the ceiling of a room, which is a protected section in a building. A sprinkler head is connected with the tip part of the fire extinguishing piping elongating from the stemmed piping in the state exposed inside the room via the ceiling surface.

The sprinkler head contains the fire extinguishing water to be compressed and supplied from the fire extinguishing piping by maintaining a valve body in the closed state by a heat sensitive operation mechanism, and the like, when there is no fire. When a fire breaks out, the valve body is opened by melting the fusible alloy provided in the heat sensitive operation mechanism so that the fire extinguishing water compressed and supplied from the fire extinguishing piping can be discharged.

According to the sprinkler head, a sealing member needs to be provided in the valve body for improving the closeness in containing the fire extinguishing water by the valve body when there is no fire. In a conventional sprinkler head, a copper sealing member has been used for the sealing member, however, since the copper sealing member has a low elasticity, it is required to apply a large load onto the sealing member for improving the sealing property so as to enhance the close contact with the valve body. Furthermore, a problem is involved in that a strength sufficient for enduring the sealing load is required in the parts where the load is to be applied, such as the heat sensitive operation mechanism, and the like, because a large load needs to be applied. Besides, it is also problematic that a copper sealing member can easily corrode.

As a method for solving the problems, a sprinkler head according to Japanese Unexamined Utility Model Publication No. 163552/1989 shown in FIG. 4 comprises a sealing member 113 of a valve body 104 made from a fluorine resin so as to maintain the sealing property, the anti-corrosion property, and the weathering resistance with a smaller load with respect to a conventional metal packing.

Furthermore, in order to solve the problem of the copper sealing member, a sprinkler head according to the official gazette of Japanese Examined Utility Model Publication No. 36677/1995 shown in FIG. 5 comprises an O ring 214 made from a fluorine resin as the sealing member for a valve body 215 such that the O ring 214 keeps the sealing property by the surface contact with O ring storing grooves 213, 216*a*.

As another method for solving the problems, the use of a rubber O ring in place of a copper sealing member is conceivable, however, since a rubber O ring may be altered by a long term use so as to adhere onto the valve body or the water discharging opening end part to disturb the smooth operation, or generate sealing leakage, a fluorine resin O ring 214 is used in the above-mentioned second prior arts.

However, according to the sprinkler head with a fluorine resin sealing member in place of a copper sealing member shown in FIG. 4, since a fluorine resin does not have an elasticity as much as a rubber, still a comparatively large assembly load needs to be applied onto the sealing member in order to improve the sealing property. Besides, a problem is involved in that a strength sufficient for enduring the sealing load is required in the heat sensitive operation mechanism.

Similarly, according to the sprinkler head with a fluorine resin O ring shown in FIG. 5, since a fluorine resin does not have an elasticity like a rubber, a sufficient sealing property cannot be obtained by the deformation of the fluorine resin O ring 214 by the hydraulic pressure of the compressed fire extinguishing water from the water discharging opening 211 contained by the valve body 215. Therefore, a problem is involved in that a strength sufficient for enduring the sealing load is required in the heat sensitive operation mechanism because a comparatively large assembly load needs to be applied onto the sealing member 214 by the assembly of the heat sensitive operation mechanism.

SUMMARY OF THE INVENTION

In order to solve the above-mentioned problems in the conventional sprinkler heads, an object of the present invention is to provide a sprinkler head, utilizing both advantages of the anti-corrosion property and the weathering resistance of a fluorine contained resin, and the elasticity of a rubber, capable of obtaining the sealing property with a smaller load, without the risk of the malfunction caused by the alteration or adhesion.

In order to achieve the object, the present invention has the following configuration.

The subject of the present invention is a closed type sprinkler head, connected with a fire extinguishing piping for compressing and supplying fire extinguishing water, for containing the fire extinguishing water to be compressed and supplied by the fire extinguishing piping by maintaining a valve body provided therein in a predetermined closed state when there is no fire, and for discharging the fire extinguishing water to be compressed and supplied by the fire extinguishing piping by having the valve body in a predetermined opened state when a fire breaks out.

In the sprinkler head according to the present invention, a sealing member comprising a rubber base material coated with a fluorine contained resin coating is mounted to the valve body so that the fire extinguishing water is contained by closing the gap between the valve body and the part surrounding the valve body with the sealing member.

The rubber base material of the sealing member can be formed with a ring-like shape with an optional cross-sectional shape. The cross-sectional shape can be round, oval, U-shape, Y-shape, X-shape, or another polygonal shape. The rubber base material can be made from a fluorine rubber or a silicon rubber.

The fluorine contained resin coating material for the sealing member can be prepared by mixing a heat setting resin material to a tetrafluoroethylene lubricant as a binder. Or an oil resistant fluorine contained resin coating material can be used as the fluorine contained resin coating material.

As mentioned above, since the sprinkler head according to the present invention comprises a sealing material made of a rubber base material, and thus the contact area can be wider by utilizing the elasticity of the rubber itself, the sealing property can be ensured with a smaller load with respect to conventional metal sealing members or fluorine resin sealing members.

Moreover, since the rubber base material itself does not come in direct contact with the fire extinguishing water or the valve part, owing to the coat on the rubber base material with the fluorine contained resin, adhesion by alteration or deterioration can be prevented so that the anti-corrosion property, and the weathering resistance of the rubber base material itself and the sealing member as a whole can be improved.

Furthermore, the friction coefficient of the sealing member can be lowered according to the coat on the rubber base material with the fluorine resin. Specifically speaking, for example, the friction coefficient of the sealing member prepared by coating the rubber member with the fluorine contained resin coating material is 0.1 to 0.3 based on the friction coefficient of the rubber base material as 1, that is, the friction coefficient can be lowered to 10 to 30%. Therefore, the starting friction of the sealing member can be made extremely small so that the smooth opening operation of the valve body can be ensured with a small power.

DESCRIPTION OF THE PREFERRED EMBODIMENTS

Figure 1:
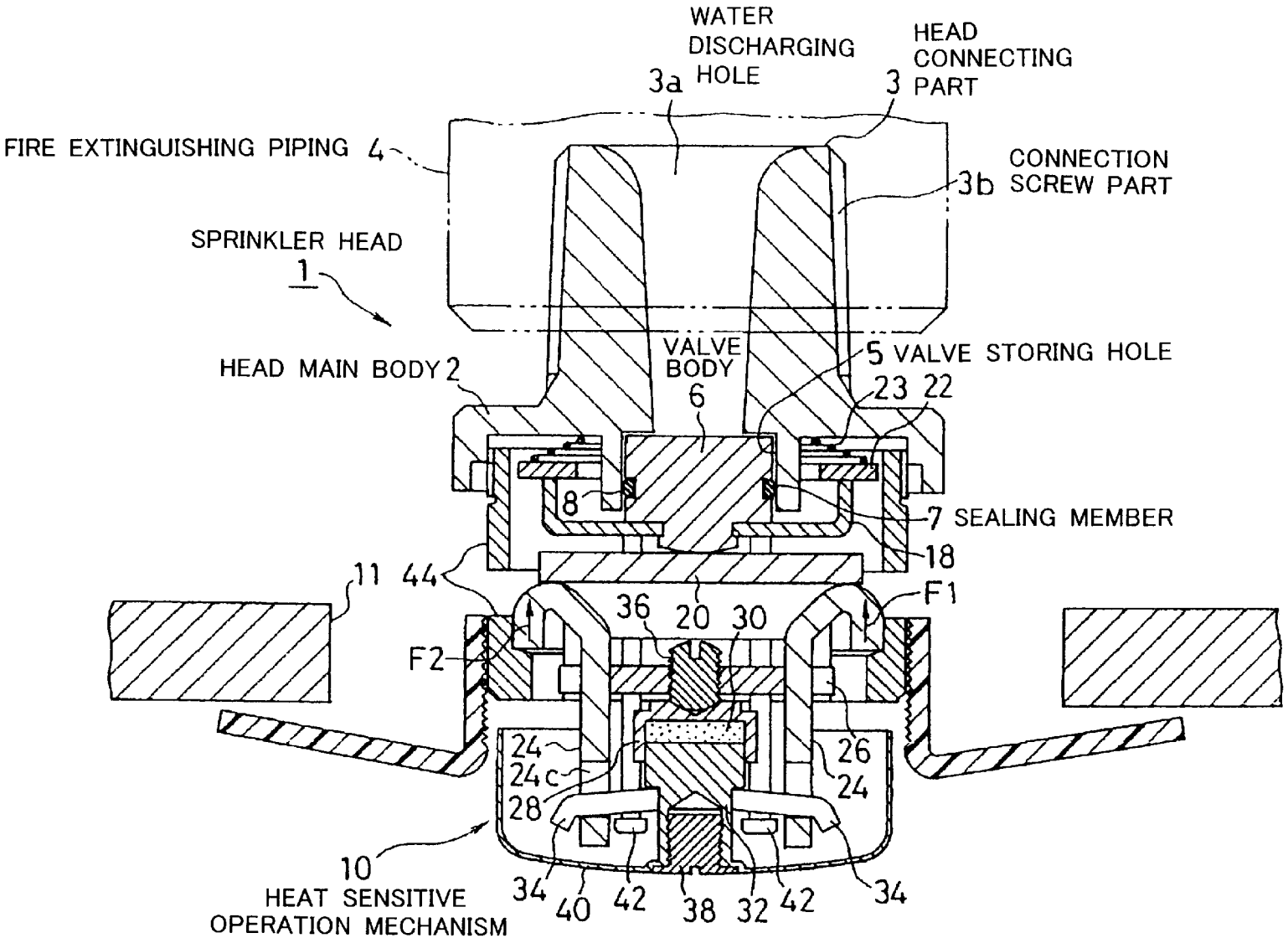
FIG. 1 is a longitudinal cross-sectional view of the entirety of a sprinkler head according to an embodiment of the present invention.

In FIG. 1, a sprinkler head 1 comprises a head main body 2, with a head connecting part 3 having a water discharging hole 3*a* formed integrally in the upper part of the head main body 2.

On the other hand, a stemmed piping stemmed from the water supply piping for supplying fire extinguishing water is provided inside the ceiling of the protected section. A fire extinguishing piping 4 elongates from the stemmed piping. The sprinkler head 1 is connected with the fire extinguishing piping 4 by fixing a connection screw part 3*b* formed on the outer periphery of the head connecting part 3 into the fire extinguishing piping 4 by screwing. In this state, the sprinkler head 1 is exposed inside the protected section via mounting hole 11 on the ceiling surface.

The water discharging hole 3*a* penetrating through the head main body 2 communicates with a valve storing hole 5 provided below, with a step part formed therebetween. A valve body 6 is stored in the valve storing hole 5, with a heat sensitive operation mechanism 10 provided below the valve body 6 such that the valve body 6 is supported in the closed state. A ring-like sealing groove 8 is formed in the outer periphery of the valve body 6, with a sealing member 7 mounted on the sealing groove 8.

Figure 2:
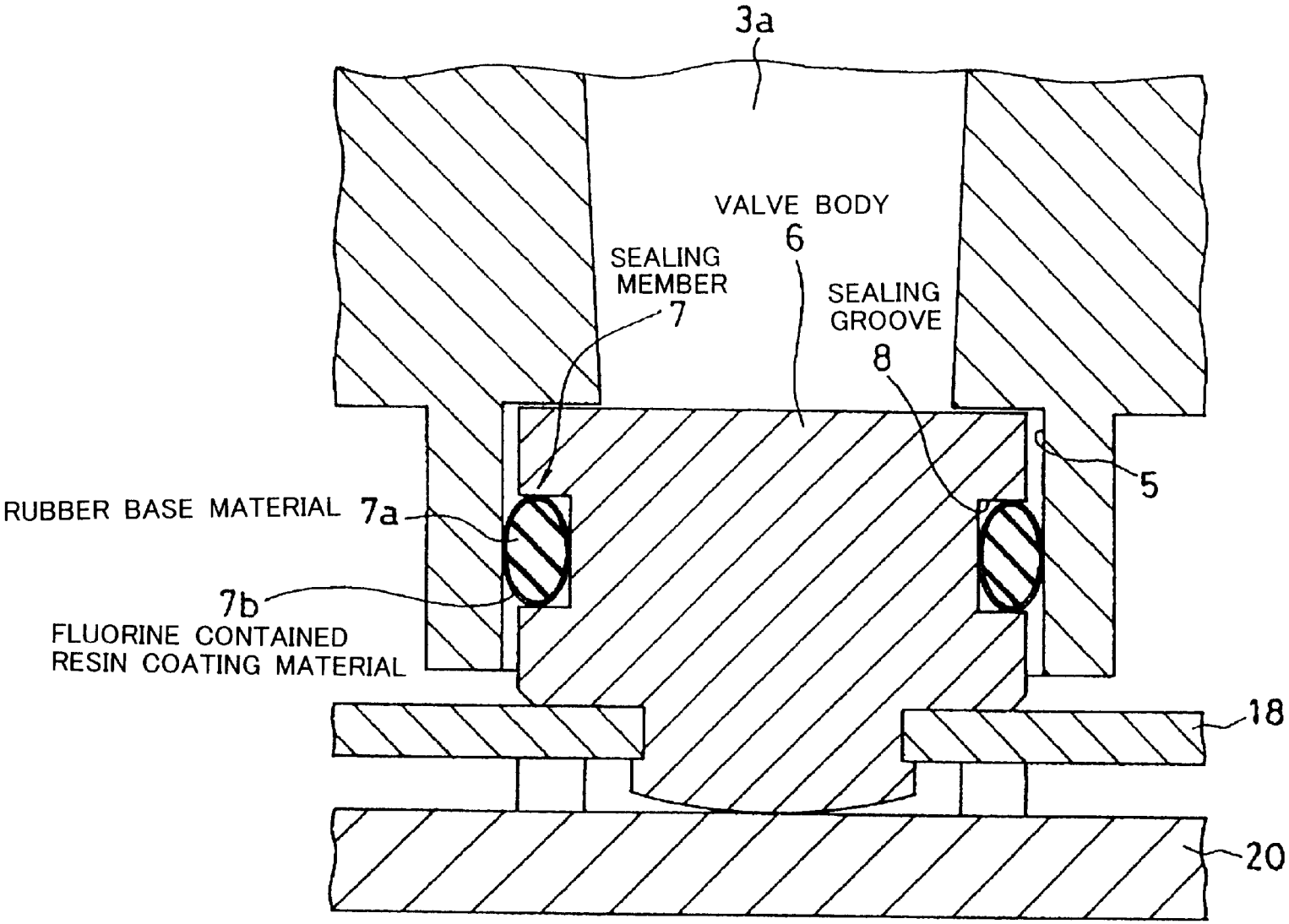
FIG. 2 is a longitudinal cross-sectional view of the valve body sealing structure of FIG. 1.

FIG. 2 shows the sealing structure of the valve body 6 of FIG. 1. The sealing member 7 mounted on the sealing groove 8 of the valve body 6 comprises an O ring made of a rubber base material 7*a* coated with a fluorine contained resin coating material 7*b*.

The sealing member 7 is prepared by evenly blowing a coating material, which is a mixture of a fluorine contained resin and a binder such as a thermoplastic resin, and the like, to the O ring as the rubber base material 7*a*, followed by drying. Since the coat film of the fluorine contained resin coating material 7*b* is extremely thin, the elasticity of the rubber base material 7*a* can be provided as it is.

The sealing member 7 can be prepared by other methods or with other materials. For example, it can be provided by coating a coating material, which is a mixture of a tetrafluoroethylene lubricant and a heat setting resin material as a binder. That is, one prepared by coating a fluorine contained resin onto a rubber base material can be used.

The thickness of the fluorine contained resin coating material can be 5 to 20 $\mu$m here, but the thickness is not limited thereto. Furthermore, it is more preferable to use an oil resistant fluorine contained resin coating material, which is resistant to the oil and grease.

As shown in FIG. 1, the heat sensitive operation mechanism 10 comprises a deflector 18 adhered with the valve body 6 and a saddle 20. The peripheral rim of the deflector 18 is bent upward. A spring 23 is disposed between a guide ring 22 provided above and the head main body 2 side. The tip of the upper bent part of a pair of levers 24 is contacted with the lower part of the saddle 20. A supporting plate 26 is assembled between the upper part of the pair of the levers 24. The supporting plate 26 is mounted with a screw 36 in the center part as well as the levers 24 are inserted into the right and left engaging grooves from the outer side.

A cylinder 28 is disposed below the supporting plate 26, with the tip of a plunger 32 placed in the cylinder 28 via a low temperature solder 30. The plunger 32 is engaged with the tip parts of a pair of balances 34 from both sides at the lower step part, with the outer side of the balances 34 fitted into the lower side opening part 24*c* of the levers 24. A set screw 36 is screwed into the screw hole of the supporting plate 26 above the cylinder 28 so as to press the counterbore hole formed on the end face of the cylinder 28. A cap-like heat collecting board 40 is fixed to the lower side of the plunger 32 with a screw 38.

Furthermore, a pair of guide pins 42 elongates from the head main body 2 side so as to be fitted into the deflector 18 slidably. The mechanism structure from the valve body 6 at the upper part to the heat collecting board 40 at the lower part is assembled and fixed by screwing a frame 44 into the lower part of the head main body 2.

According to the assembly load of the frame 44 to the head main body 2, the assembly load F1, F2 is applied to the levers 24 with the tip part contacting with the saddle 20 as shown in the figure so that the levers 24 are applied with the angular moment toward the outside, which is stopped by the balances 34 engaged with the plunger 32.

The operation of the embodiment shown in FIGS. 1 and 2 will be explained. In an ordinary time, that is, when there is no fire, as shown in FIGS. 1 and 2, the valve body 6 is maintained in the valve storing hole 5 of the head main body 2 by the heat sensitive operation mechanism 10 (in a predetermined closed state) so as to contain the compressed fire distinguishing water to flow into the water discharging hole 3*a*, filled in the fire extinguishing piping 4 by the sealing member 7.

At the time, the sealing member 7 is placed in the sealing groove 8 so as to closely contact the fluorine contained coating material 7*b* with the inner peripheral surface of the valve storing hole 5 (periphery part of the valve body 5) and the outer peripheral surface of the sealing groove 8 by the elastic deformation of the rubber base material 7*a* as shown in the enlarged view in FIG. 2. At the same time, the rubber base material 7*a* is elastically deformed by the pressure of the compressed fire extinguishing water filled in the water discharging hole 3*a* so as to closely contact the fluorine contained coating material 7*b* to the inner peripheral surface of the valve storing hole 5 and the outer peripheral surface of the sealing groove 8.

As mentioned above, the deformation amount necessary for obtaining the sealing property can be provided to the sealing member 7 by the elastic deformation generated by placing the rubber base material 7*a* in the sealing groove 8 and the elastic deformation generated from the pressure of the compressed fire extinguishing water. Therefore, unlike the prior arts, the necessary deformation amount can be provided to the sealing member 7 without the need of the assembly load of the heat sensitive operation mechanism 10. Accordingly, the heat sensitive operation mechanism 10 only needs to apply the assembly load necessary for maintaining the valve body 6 in the closed position shown in the figure, resisting to the pressure of the compressed fire extinguishing water.

Figure 4:
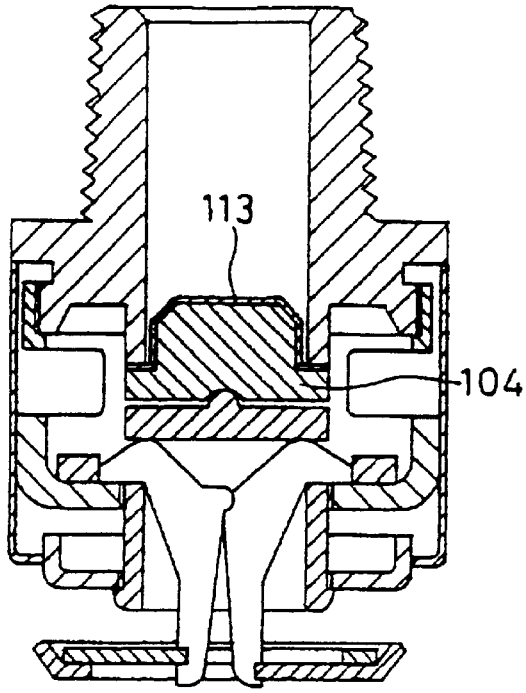
FIG. 4 is a longitudinal cross-sectional view of the entirety of a conventional sprinkler head with a fluorine resin sealing member.
Figure 5:
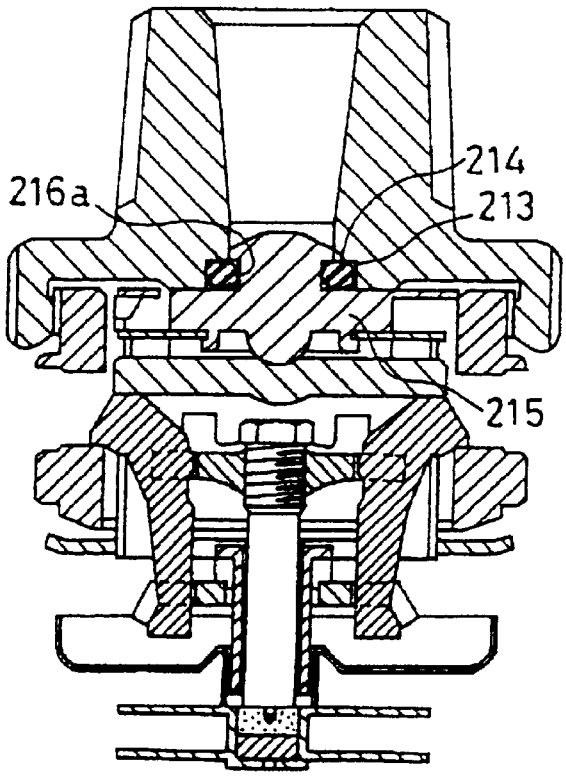
FIG. 5 is a longitudinal cross-sectional view of the entirety of a conventional sprinkler head with a fluorine resin O ring.

Since the contact area of the sealing member 7 can be made wider by utilizing the elasticity of the rubber base material 7*a*, the sealing property can be maintained with a smaller load compared with the fluorine resin sealing member shown in FIG. 4 or the fluorine resin O ring shown in FIG. 5. Moreover, although the sealing member 7 is always contacted with the fire extinguishing water filled in the water discharging hole 3*a* side, since the rubber base material 7*a* is coated with the fluorine contained coating material 7*b*, the rubber base material 7*a* does not come in direct contact with the fire extinguishing water, and thus the anti-corrosion property of the rubber base material 7*a* can be ensured.

Moreover, although the open side of the sealing member 7 is exposed to the atmosphere, since it is coated with the fluorine contained coating material 7*b*, the rubber base material 7*a* does not come in direct contact with the atmosphere, and thus the weathering resistance can be ensured. Furthermore, since the sealing member 7 is contacted with the valve storing hole 5 of the head main body 2 by the fluorine contained coating material 7*b*, adhesion can be prevented even if it is not operated for a long time, and thus the valve body 6 can be moved smoothly at the time of a fire.

The upper surface of the valve body 6 and the lower step part of the water discharging hole 3*a* are contacted with each other so that ducts in the fire extinguishing water cannot be stagnated in the vicinity of the sealing member 7.

The operation at the time of a fire will be explained. The sprinkler head 1 receives the heat of the fire at the heat collecting board 40 when a fire breaks out. Therefore, if the low temperature solder 30 reaches to the melting temperature so as to melt, the plunger 32 moves upward so that the engagement of the balances 34 by the cylinder 28 and the plunger 32 is released. When the balances 34 are released, the engagement of the levers 24 is released accordingly so that the balances 34 and the levers 24 are detached and dropped. Accordingly, the saddle 20 and all the members provided therebelow drop off.

According to the sprinkler head 1 operation, the deflector 18 supported upward by the saddle 20 is dropped off by the force of the spring 23 so as to be maintained at the tip position of the guide pins 42. At the same time, the valve body 6 is dropped off (in a predetermined opened state) so that the valve storing hole 5 of the head main body 2 is opened so as to discharge the fire extinguishing water.

Figure 3:
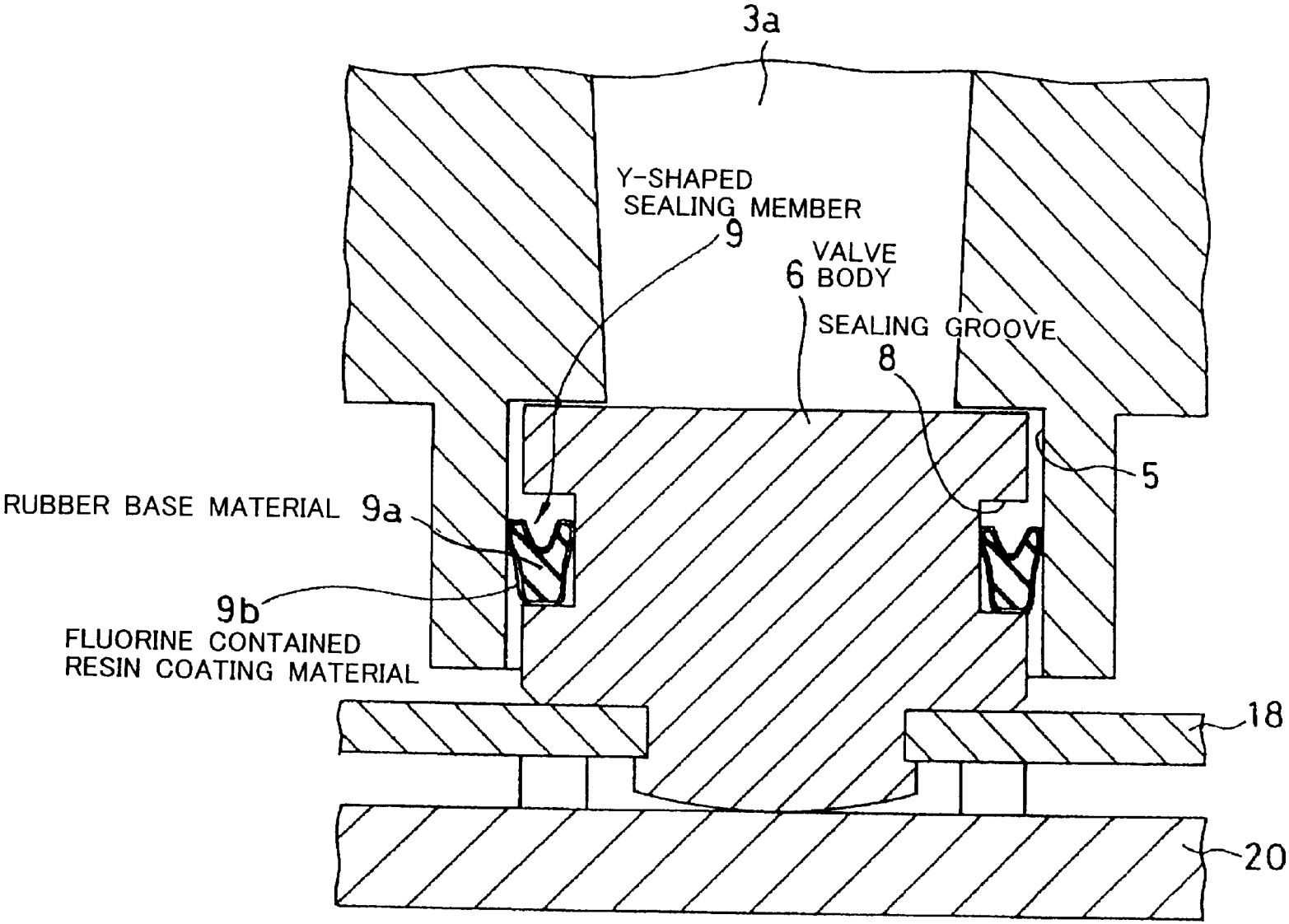
FIG. 3 is a longitudinal cross-sectional view of the valve body sealing structure of another embodiment.

FIG. 3 shows another embodiment of the present invention, which employs a sealing member with a sealing member having a Y-shaped cross-sectional shape as the sealing member of the valve body. In FIG. 3, the Y-shaped sealing member 9 stored in the sealing groove 8 of the valve body 6 has a cross-sectional lip shape opened toward the fire extinguishing water supply side with a Y-shape, prepared by coating a fluorine contained coating material 9*b* to a rubber base material 9*a*.

According to the elastic deformation of the rubber base material 9*a*, the Y-shaped sealing member 9 presses the outer peripheral lip to the inner peripheral surface of the valve storing hole 5, and presses the inner peripheral lip to the outer peripheral surface of the sealing groove 8 in the state assembled in the sealing groove 8. At the same time, since it is expanded by the pressure of the compressed fire extinguishing water from the water discharging hole 3*a* side, the outer peripheral lip is closely contacted with the inner peripheral surface of the valve storing hole 5, and the inner peripheral lip is closely contacted with the outer peripheral surface of the sealing groove 8.

The contact area of the Y-shaped sealing member 9 in this case can be made smaller compared with the case of the sealing member 7 comprising the O ring shown in FIG. 2 so that the sliding resistance of the valve body 6 can be made smaller and thus the valve body 6 can be opened with a small force at the time of a fire.

Although the round shape and the Y-shape have been explained as examples of the cross-sectional shape of the sealing member in the above-mentioned embodiments, optional cross-sectional shapes, such as U-shape, V-shape, X-shape, and another polygonal shape, can be adopted as needed.

Moreover, by using a fluorine rubber as the rubber base material 7*a* of the sealing member 7, the heat resistance, the chemical resistance, and the weathering resistance can further be improved. For the rubber base material 7*a*, a silicon rubber can be used as well.

Furthermore, a sprinkler head according to the present invention is not limited to the sprinkler head configuration of the above-mentioned embodiments, but it can be adopted to anyone with an optional structure as long as a sealing member prepared by coating a rubber base material with a fluorine contained coating material is used.

What is claimed is:

1. A closed type sprinkler head, connected with a fire extinguishing piping, for compressing and supplying fire extinguishing water for containing the fire extinguishing water to be compressed and supplied by the fire extinguishing piping by maintaining a valve body provided therein in a predetermined closed state when there is no fire, and for discharging the fire extinguishing water to be compressed and supplied by the fire extinguishing piping by having the valve body in a predetermined opened state when a fire breaks out, wherein a sealing member comprising a rubber base material coated with a fluorine contained resin coating is mounted to the valve body so that the fire extinguishing water is contained by closing the gap between the valve body and the part surrounding the valve body with the sealing member.

2. The sprinkler head according to claim 1, wherein the rubber base material of the sealing member is formed with a ring-like shape with an optional cross-sectional shape.

3. The sprinkler head according to claim 1 or 2, wherein the cross-sectional shape of the rubber base material of the sealing member is round, oval, U-shape, Y-shape, X-shape, or another polygonal shape.

4. The sprinkler head according to claim 1 or 2, wherein the rubber base material of the sealing member is made from a fluorine rubber.

5. The sprinkler head according to claim 1 or 2, wherein the rubber base material of the sealing member is made from a silicon rubber.

6. The sprinkler head according to claim 1 or 2, wherein the fluorine contained resin coating material for the sealing member is prepared by mixing a heat setting resin material to a tetrafluoroethylene lubricant as a binder.

7. The sprinkler head according to claim 1 or 2, wherein an oil resistant fluorine contained resin coating material is used as the fluorine contained resin coating material.

* * * * *